US007070735B2

(12) United States Patent
Touma et al.

(10) Patent No.: US 7,070,735 B2
(45) Date of Patent: Jul. 4, 2006

(54) ALUMINUM ALLOY MATERIAL FOR FORGING AND CONTINUOUS CASTING PROCESS THEREFOR

(75) Inventors: Kiyotaka Touma, Wako (JP); Yushi Amaki, Wako (JP); Ichiro Fujimoto, Wako (JP); Tomokazu Yamashita, Shinminato (JP); Hidetoshi Takagi, Shinminato (JP); Toru Watanabe, Shinminato (JP)

(73) Assignees: Honda Giken Kogyo Kabushiki Kaisha, Tokyo (JP); Toyama Alloy Co., Ltd., Toyama (JP)

( * ) Notice: Subject to any disclaimer, the term of this patent is extended or adjusted under 35 U.S.C. 154(b) by 0 days.

(21) Appl. No.: 10/623,796

(22) Filed: Jul. 22, 2003

(65) Prior Publication Data

US 2004/0134572 A1 Jul. 15, 2004

(30) Foreign Application Priority Data

Jul. 22, 2002 (JP) ..... 2002-212593

(51) Int. Cl.
*C22C 21/00* (2006.01)
*B22D 11/00* (2006.01)

(52) U.S. Cl. ..... 420/528; 148/551; 148/437; 164/459

(58) Field of Classification Search ..... 164/459; 148/551, 437; 420/528
See application file for complete search history.

(56) References Cited

U.S. PATENT DOCUMENTS

| | | | | |
|---|---|---|---|---|
| 2,166,496 | A * | 7/1939 | Igarashi et al. | 420/532 |
| 4,157,728 | A * | 6/1979 | Mitamura et al. | 164/452 |
| 6,120,621 | A * | 9/2000 | Jin et al. | 148/437 |

FOREIGN PATENT DOCUMENTS

| | | |
|---|---|---|
| JP | 01-283337 | 11/1989 |
| JP | 3-110043 | 5/1991 |
| JP | 4-2740 | 1/1992 |
| JP | 07-145440 | 6/1995 |
| JP | 07-150312 | 6/1995 |
| JP | 07-197216 | 8/1995 |
| JP | 9-272941 | 10/1997 |
| JP | 2000-144296 | 5/2000 |

OTHER PUBLICATIONS

"Aluminum and Aluminum Alloys", ASM International, 1993, pp. 88-89.*

* cited by examiner

*Primary Examiner*—George Wyszomierski
*Assistant Examiner*—Janelle Morillo
(74) *Attorney, Agent, or Firm*—Arent Fox PLLC

(57) ABSTRACT

An aluminum alloy material for forging obtained by a continuous casting process, the alloy comprising: a surface of which roughness is not more than Ra 35, and a segregation layer having 0.1 to 2 mm thickness and generated in the surface. The cast surface after continuous casting is smooth without peeling, a cast material can be forged without any treatment, and a segregation layer remains in a surface layer, thereby inhibiting coarsening of recrystallization grains and exhibiting superior toughness and strength.

4 Claims, 4 Drawing Sheets

ALUMINUM ALLOY MATERIAL FOR FORGING AND CONTINUOUS CASTING PROCESS THEREFOR

BACKGROUND OF THE INVENTION

1. Field of the Invention

The present invention relates to an aluminum alloy material for forging and to a continuous casting process therefor, and more particularly, relates to a technique in which parts such as automobile parts, which are required to have high strength and high toughness, can be mass-produced at low cost.

2. Related Art

Forging of light metals such as aluminum is generally performed by die forging after heating a billet produced by extruding a circular cross section or by casting such as continuous casting, semi-continuous casting, or gravity casting at a predetermined temperature. The forging provides materials of a desired strength and toughness. Production process of an aluminum alloy forged product is substantially as follows. That is to say, hot forging is performed on a billet by reheating it to 350 to 550° C. after performing base metal melting of the alloy mixture, billet continuous casting, billet cutting, surface peeling, and homogenizing treatment, whereby a required product shape is obtained. In such a production process, many steps are required, and unnecessary parts, such as a flash, must be removed as scrap, and therefore, the process results in high cost. The proportion of material cost in the forging cost is high, for example, not less than about 30%. Therefore, the material cost for the forging must be reduced as much as possible in order to yield inexpensive forged products.

Known processes for producing aluminum alloy material for forging are as follows.

(1) DC (Direct Chill) Casting Process or Hot-Top Continuous Casting Process

The surface of a bar of material cast by a continuous casting process is peeled off, and the bar is cut to the required length to obtain the material.

(2) Extrusion Bar or Shape

A bar of material cast by a continuous casting process is hot-extruded with a circular cross section or heteromorphic cross section to obtain the material.

(3) Heteromorphic Continuous Cast Billet

A material having a heteromorphic cross section cast by a continuous casting process is sliced to obtain billets.

(4) Cast Products are Used for Forged Materials (Cast Forging)

A material cast in a near net shape (a shape which is approximate to a product) is lightly forged to obtain the material.

(5) Heat Insulating Mold Continuous Casting Process

A mold has a heat insulating structure, and casting is performed while cooling the mold with cooling water spouted from the lower end of the mold to obtain a billet by a casting process in which contact between the mold and the billet is greatly reduced.

In the process described in (1), a periodic inverse segregation layer called a ripple or laps is formed in periodic contact portions with the mold and in boundaries between a header and the mold. When forging is performed in a state of the surface on which the periodic inverse segregation layer is generated, a rough portion is formed on the surface as damage, and the quality is therefore deteriorated. In order to avoid the deterioration of quality, peeling in which the inverse segregation layer is cut off to remove it is performed. However, the manufacturing cost increases because the cost for additional equipment is necessary. In Hot-Top casting of a gas pressurizing type, control of the gas pressure conditions to obtain a smooth cast surface is complicated, and the apparatus is complicated, thereby increasing the equipment cost.

In the process described in (2), the number of steps is comparatively large, thereby increasing the production cost. Moreover, intergranular corrosion occurs because the surface has a coarse recrystallization structure. Therefore, the strength is decreased as a result of the corrosion. According to Japanese Unexamined Patent Application (KOKAI) Publication No. 7-197216, the fatigue strength and intergranular corrosion characteristics of 6000 system aluminum alloy, which is a heat-treated type of alloy, is increased by providing compressive residual stress. However, the production cost is increased because an additional process for providing the compressive residual stress is required. In Japanese Unexamined Patent Application (KOKAI) Publication No. 7-150312, coarse recrystallization is suppressed by omitting a homogenizing treatment before extruding. However, this proposal does not result in a drastically lower cost by decreasing the number of processes because an additional extruding step is required.

In the process described in (3), the surface quality of a billet is equivalent to that in (3) of the material obtained by the process in (1), and therefore, the process has the same problems as the process in (1). Moreover, in the process in (3), since the cooling structure of the mold is complicated the equipment cost for the apparatus is large, and therefore, the production cost is large.

In the process described in (4), casting molds and dies having shapes corresponding to the finished shapes of the product are required for the casting process and the forging process. Moreover, automation for performing mass production for casting to a complicated shape is difficult. Furthermore, for casting to a complicated shape, it is necessary to increase castability by adding Si. However, the addition of Si decreases forgeability, so that the working ratio after casting is comparatively low. Therefore, the casting structure is liable to remain, and the toughness and strength are lower than those in usual forged products. Moreover, examination for defects in casting, such as cavities is required, and consistent quality cannot be obtained.

In the process described in (5), peeling is not required because a comparatively smooth cast surface can be obtained. However, a segregation layer is formed on a billet surface in continuous casting and is projected to form protrusions, which may be melted in a homogenizing treatment and may result in tucking damage in forging. Therefore, a consistently smooth surface is difficult to obtain.

In addition to the above-mentioned technologies to (1) to (5), an electromagnetic continuous casting process has been proposed as a new technique. However, this technique requires special equipment such as electromagnetic shielding, and the equipment cost thus increases, and it is difficult to produce at a low cost with this technique.

In order to produce inexpensive parts, generally, the material cost must be reduced as much as possible. However, extruding requires many steps, and application thereof is limited to small parts with good production efficiency and cold forging in which a material is forward or backward extruded. When large car parts such as suspensions are produced, the cross section thereof is large and the production cost is high. Therefore, this technique cannot be applied largely selling to cars, and these cars cannot be reduced in weight by using aluminum alloy.

When a billet is produced by the above-mentioned continuous casting or semi-continuous casting, the cost can be relatively low. However, surface defects such as sweating, melting, ripple, and laps occur on the cast surface in a solidification process. Therefore, when the forging is performed without any treatment, the surface defects remain as damage after forging, and satisfactory quality cannot be obtained. Therefore, the production cost increases because peeling must be performed on the surface.

Extrusion bars, shapes, and billets produced by continuous casting have a mill scale surface. Therefore, if the die temperature and preheating in hot working are not exactly controlled, the grain recrystallized from the mill scale is coarse and the strength and elongation will be decreased. In order to avoid this problem, suppressing the coarsening of the recrystallization grains by adding Mn, Cr, Zr is proposed in Japanese Unexamined Patent Application (KOKAI) Publication No. 1-283337, Japanese Unexamined Patent Application (KOKAI) Publication No. 7-145440, and Japanese Unexamined Patent Application (KOKAI) Publication No. 2000-144296. However, the final forging temperature must be higher than the recrystallization temperature so as to suppress coarsening of the grain. In a process of forging in heat for the cost reduction and working temperature easily decrease as the forging is performed, and coarse recrystallization grains are easily formed. As is mentioned in the above, coarsening of the recrystallization grains results in a decrease in strength and elongation. In practice, parts are often used with mill scale other than a test piece supplied for investigating the characteristics. Therefore, many problems actually remain in the coarsening of the recrystallization structure of surface layer.

SUMMARY OF THE INVENTION

Therefore, objects of the present invention are to provide an aluminum alloy material for forging and a continuous casting process therefor in which a cast surface after continuous casting is smooth without peeling; a cast material can be forged without any treatment; and a segregation layer remains in a surface layer, thereby inhibiting coarsening of recrystallization grains and exhibiting superior toughness and strength.

FIG. 1A shows a conventional casting mechanism according to a heat insulating mold continuous casting process. Reference numeral 2 in FIG. 1A shows a mold, and reference numeral 3 shows a cooling water jacket in which cooling water W is spouted to a cast material. A discharge opening 2*a* having a circular cross section is formed in the mold 2, and has a tapered shape of which diameter is increased toward the discharging side. A melted metal is cast such that a complete liquid phase area M1 transforms to a complete solid phase area M3 via a solid-liquid coexistence area M2. Solidification interface m is formed at a boundary between the complete solid phase area M3 and the solid-liquid coexistence area M2, and the solidification interface m approximately coincides with a discharge edge 2*b* in the discharge side of the mold 2. Therefore, as shown in this FIG. 1A, an oxide film S is partially broken by the edge 2*b* of mold 2, and the liquid portion of the solid-liquid coexistence area M2 percolates through the broken portion. As a result, surface protrusions are formed so as to form defects in the cast surface. An object of the present invention is to avoid such a phenomenon. The inventors found that it is important to use an effect of the stable oxide film formed in the solidification process and the elasticity of the half solidified portion in order to ensure a smoothness of the cast surface in the heat insulating mold continuous casting process.

In particular, the casting rate is controlled such that the solidification interface m of the aluminum alloy material is positioned inside the mold 2 away from the discharge edge 2*b,* as shown in FIG. 1B. The solidification interface m can be formed at any position of the tapered portion in the discharge opening 2*a*. By controlling the casting rate in the above-mentioned manner, the solid-liquid coexistence area M2 protected by the oxide film S and having excellent elasticity is smoothly extracted from the mold 2 without breaking the oxide film S by edge 2*b,* and a smooth cast surface is therefore obtained. The diameter of a casting bar is smaller than the diameter of the edge 2*b* (the diameter of the lowermost portion of the discharge opening). However, there is no problem by properly setting the casting rate and the size of the mold according to the production level. It is desirable that the solidification interface be controlled, as much as possible, to a position in the vicinity of the edge 2*b*. According to such control, the material can be cooled quickly and the crystal grains can be made fine.

The continuous casting process for aluminum alloy material for forging of the present invention is made based on the above-mentioned knowledge. That is, the present invention provides a continuous casting process for an aluminum alloy material for forging, the process comprising: charging a melted metal consisting of the aluminum alloy material into a mold at a predetermined casting rate, the mold having a discharge edge through which the solidified aluminum alloy material is discharged; and controlling the casting rate such that a solidification interface of the aluminum alloy material is positioned inside the mold away from the discharge edge. The present invention further provides an aluminum alloy material for forging obtained by a continuous casting process, the alloy comprising: a surface of which roughness is not more than Ra 35, and a segregation layer having 0.1 to 2 mm thickness and generated on the surface. The aluminum alloy for forging in the present invention may be preferable produced by the above process. An aluminum alloy in the present invention may be selected from the group consisting of 2000 system, 3000 system, 4000 system, 5000 system, 6000 system and 7000 system alloys.

A coarse recrystallization structure, which has been a conventional problem, is inhibited by a pinning effect as the amount of impurities becomes large. According to the present invention, the segregation layer, which has been known to be disadvantageous, is a material for inhibiting the formation of coarse recrystallization grains. Therefore, a material having a stable oxide film, generated in a surface layer, and having high fatigue strength under stress in a range from an intermediate degree to a low degree can be obtained.

As a control process of the casting rate in the present invention, it may be mentioned to repeatedly perform acceleration and deceleration such that a solidification interface of the aluminum alloy material is positioned inside the mold away from the discharge edge instead of fixing the casting rate. According to the control of the casting rate, the position of the solidification interface always varies, and a smooth surface can be obtained consistently. FIG. 2 shows casting rate graphs of the invention and a conventional technique. By controlling the casting rate as in the invention, the solidification interface moves slightly, so that adhesion between the aluminum alloy and the mold can be inhibited, and a smooth cast surface may be obtained.

Moreover, Ca or Be can be added to the aluminum alloy material in the present invention. Ca and Be improve the casting rate and the surface quality. When the content of Ca is less than 0.005 wt %, the surface quality may not be improved. When the content of Ca is more than 0.015 wt %, the effects cannot be obtained. Therefore, the content of Ca is preferably 0.005 to 0.015 wt %. When the content of Be is not less than 0.005 wt %, the effects can be obtained. When, the content of Be is more than 0.0020 wt %, the effects can be obtained. Therefore, the content of Be is preferably 0.0005 to 0.0020 wt %.

A homogenizing treatment may be performed on the material of the present invention if necessary. As a homogenizing treatment, the material may be treated at a temperature from 20 to 40° C. below the crystallization temperature of the solid phase (solidus temperature) of the composition consisting of the segregation layer. The homogenizing treatment is indispensable for stabilizing the characteristics according to the kind of alloys, and it is desirable to perform the treatment at high temperature for as long as possible. However, the homogenizing treatment is usually performed at a temperature of about 10° C. below the solidus temperature, since partial melting occurs if the treatment is performed at a temperature higher than the solidus temperature. Conventional homogenizing treatment requires a peeling process with a thickness of 2 to 3 mm. Therefore, there is no problem if the treatment is performed at about the solidus temperature to efficiently obtain a preferable structure, whereby the segregation layer is melted at the eutectic point and gas absorption follows. However, in the present invention, the surface of the cast material is smooth, and a subsequent peeling process is not required. Therefore, heating at about the solidus temperature must be avoided, and the homogenizing treatment is performed at a temperature of 20 to 40° C. below the solidus temperature of the composition consisting of the segregation layer.

The above-mentioned homogenizing treatment is performed if necessary. In the present invention, even if the homogenizing treatment is not performed, characteristics similar to that obtained with the homogenizing treatment may be obtained. Moreover, in the present invention, a shotpeening process with shot such as glass shot is preferably performed after forging in a view of improvement of strength and toughness.

EXAMPLES

The following description will discuss the present invention based upon examples.

Figure 3:
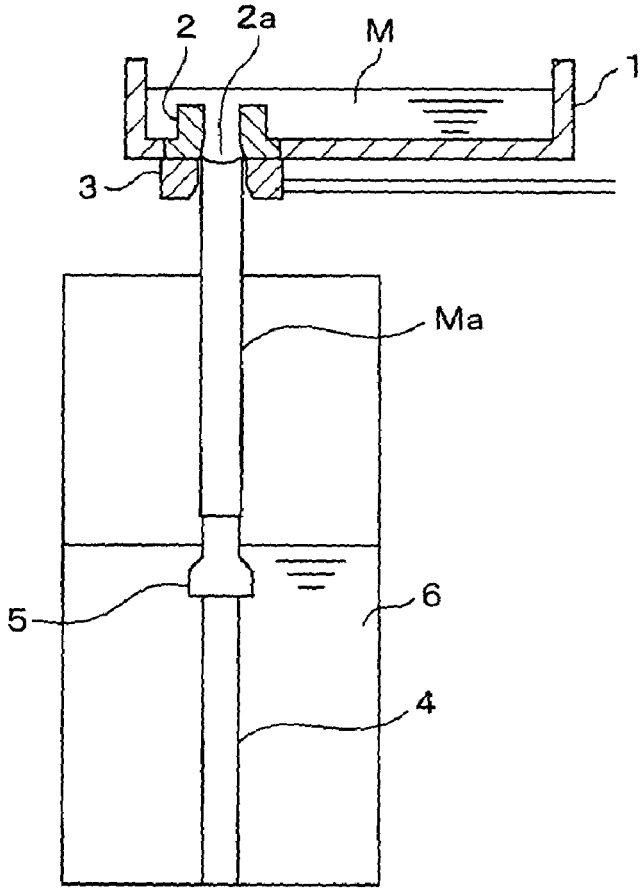
FIG. 3 is a sectional view showing an overall view of a continuous casting apparatus used in examples.

(1) Evaluation of Effects of the Present Invention Based on Difference in Casting Process FIG. 3 shows a continuous casting apparatus used in the examples. In the apparatus, a melted metal M consisting of an aluminum alloy in a tundish 1 is vertically extracted downward from a taper-shaped discharge opening 2*a* of a mold 2 of which diameter increases toward the discharging side. The melted metal M is cooled to solidify by cooling water spouted from a cooling water jacket 3. A solidified casting bar Ma is moved downward into a cooling water pit 6 by a bottom block 5 which is vertically moved by an elevator 4.

a. Casting

Example 1

Figure 1A:
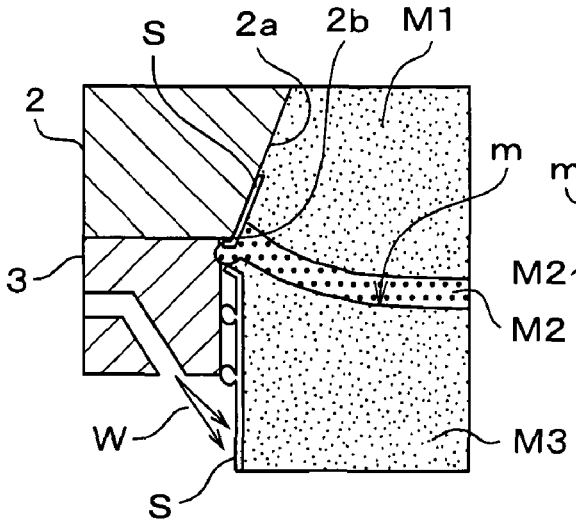
FIG. 1A is a sectional view showing a conventional casting mechanism.
Figure 1B:
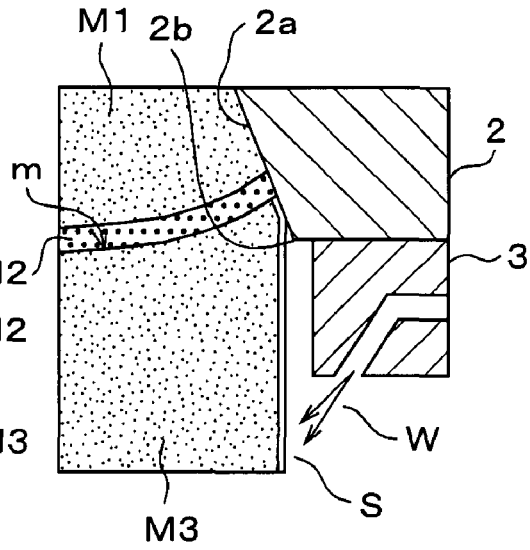
FIG. 1B is a sectional view showing a casting mechanism of the present invention.
Figure 2:
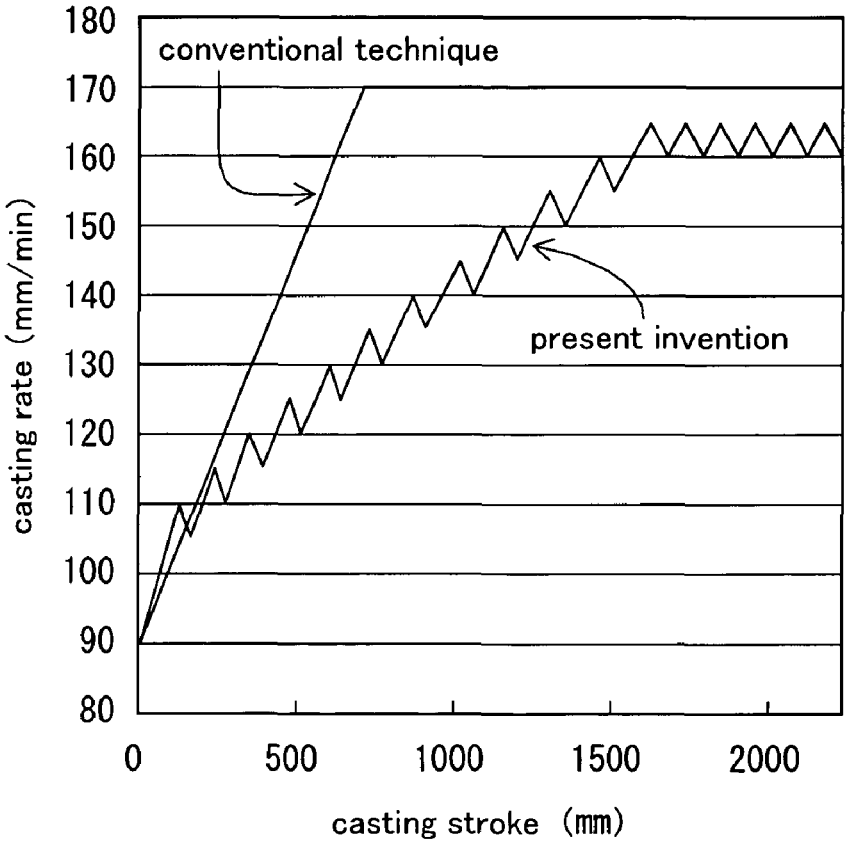
FIG. 2 shows a graph of casting rate in the present invention and a conventional technique.

6061 aluminum alloy shown in table 1 was produced by melting. The bottom block 5 was moved downward at a velocity (casting rate) of 150 mm/min by using the casting apparatus shown in FIG. 3 such that the solidification interface of the aluminum alloy material was positioned inside the mold away from the discharge edge shown in FIG. 1B. By performing the above-mentioned process, a columnar billet with a diameter of 83 mm was obtained.

Example 2

Ca was added to the 6061 aluminum alloy at 0.0075 wt %. In this alloy, the solidification interface could be positioned in the vicinity of the discharge opening of the mold since the oxide film was strengthened by Ca. The casting was performed while increasing the casting rate up to 170 mm/min.

Comparative Example 1

Casting was performed in the same way as example 1 except that a conventional DC casting was employed.

TABLE 1

| | Unit (wt %) | | | | | | | calculated solidus temperature | calculated liquidus temperature |
|---|---|---|---|---|---|---|---|---|---|
| | Si | Fe | Cu | Mn | Mg | Cr | Ti | (° C.) | (° C.) |
| 6061 composition | | | | | | | | | |
| segregation layer by EPMA | 2.6 | 1.4 | 0.8 | 0.2 | 1.4 | 0.1 | 0.02 | 559 | 638 |
| cutting surface by EPMA | 0.8 | 0.2 | 0.4 | 0.1 | 1.1 | 0.2 | 0.03 | 581 | 651 |
| cutting layer by emission spectroanalysis | 0.68 | 0.22 | 0.33 | 0.10 | 1.06 | 0.19 | 0.02 | 581 | 651 |

TABLE 1-continued

| | Unit (wt %) | | | | | | | calculated solidus temperature | calculated liquidus temperature |
|---|---|---|---|---|---|---|---|---|---|
| | Si | Fe | Cu | Mn | Mg | Cr | Ti | (° C.) | (° C.) |
| 6110 composition | | | | | | | | | |
| segregation layer by EPMA | 3.7 | 0.9 | 0.8 | 0.6 | 1.7 | 0.1 | 0.01 | 552 | 626 |
| cutting surface by EPMA | 1.0 | 0.2 | 0.3 | 0.4 | 0.9 | 0.2 | 0.02 | 573 | 650 |
| cutting layer by emission spectroanalysis | 0.96 | 0.20 | 0.35 | 0.35 | 0.83 | 0.20 | 0.02 | 573 | 650 |

b. Observation of Surface After Casting

Figure 4A:
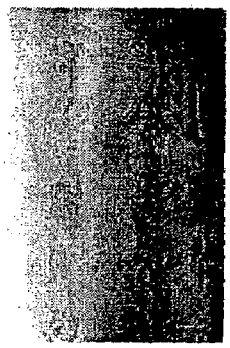
FIGS. 4A to 4C are photographs showing example cast billets.
Figure 4B:
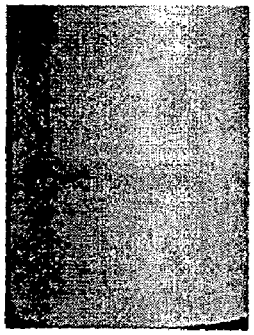
Figure 4C:
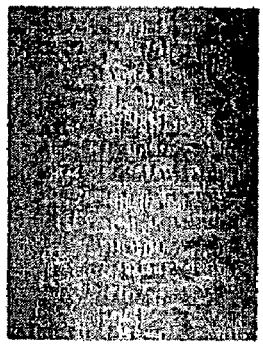

Photographs of cast billets of examples 1 and 2 are respectively shown in FIGS. 4A and 4B. Moreover, a photograph of the cast billet of comparative example 1 is shown in FIG. 4C. According to these figures, the surfaces of the cast billets of examples 1 and 2 show smooth cast surfaces equivalent to extrusions. However, the surface of cast billet of comparative example 1 shows a rough portion.

c. Thickness of Segregation Layer

Thicknesses of segregation layers of the cast billets in examples 1 and 2 and comparative example 1 were respectively examined. The thicknesses were measured in the following manner. The billets were cut perpendicularly to the casting direction, and the cut section was subjected to specular polishing. Subsequently, the cut section was dipped into an etching solution so that the amplitude of the structure was emphasized. The structure of the cut section was photographed by a metallurgical microscope, and the thicknesses of the segregation layers were measured by a scale. The segregation layer is the range from the surface layer to a layer in which grain size thereof is approximately uniform. The results are shown in table 2.

process in which the surface layer was removed at a thickness of 2 to 3 mm. The composition and solidus temperature of the segregation layer were obtained by the following manner. First, the composition of the segregation layer was analyzed with an EPMA (Electron Probe Micro Analyzer), which is a kind of X ray micro analyzer. Subsequently, the composition of the inside of the segregation layer was analyzed in the same way. Then, the data was matched with data obtained by emission spectroanalysis or wet analysis, and the EPMA values of the segregation layer were treated as almost accurate values. Lastly, the solidus temperature of the segregation layer was obtained by solidification analysis software, such as thermo calc. In the 6061 aluminum alloy and the 6110 aluminum alloy, the composition of the segregation layer obtained by the EPMA, the composition of the cutting surface at the inside of the segregation layer obtained by the EPMA, the composition of the cutting layer obtained by the emission spectroanalysis, the solidus temperature, and the liquidus temperature are shown in table 1.

e. Forging

A billet of example 2 on which the homogenizing treatment was not performed was cut to a predetermined length.

TABLE 2

| | casting process | easting rate (mm/min) | peeling | homo-genizing treat-ment | content of Ca (wt %) | thickness of segregation layer (mm) | roughness (circumferential direction) (Ra) | tensile strength (MPa) | yield strength (MPa) | elongation (%) |
|---|---|---|---|---|---|---|---|---|---|---|
| example1 | heat insulating mold continuos casting | 150 | none | done | none | 0.2 | 17 | 315y~334 | 290~306 | 16.6~22.4 |
| example2 | heat insulating mold continuos casting | 170 | none | none | 0.0075 | 0.2 | 17 | 346~356 | 317~328 | 11.8~15.4 |
| comparative example1 | DC casting | 170 | done | done | none | 2.0 | 132 | 305~350 | 289~310 | 8.7~20.4 |

d. Homogenizing Treatment

Figure 6:
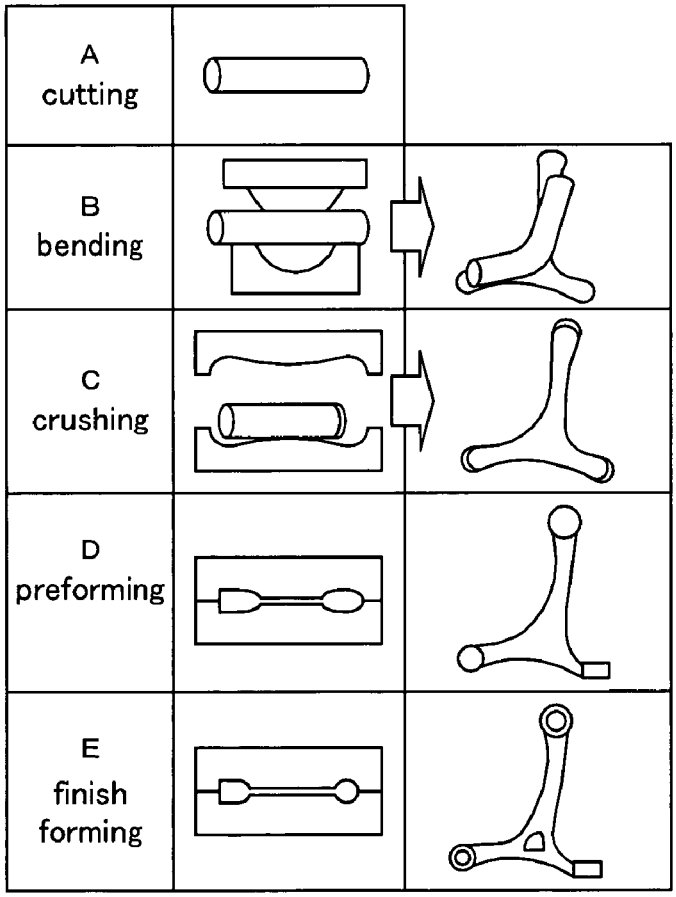
FIG. 6 shows a forged product process used to fabricate the examples.

A homogenizing treatment, in which billets of examples 1 and 2 were cut to a predetermined length and these billets were heated for 8 hours at 530° C., which was 30° C. below the solidus temperature of the composition consisting of the segregation layer, was performed. The homogenizing treatment in the billet of the example 1 was performed without a peeling process. The homogenizing treatment for the billet of the comparative example 1 was performed after a peeling The billet in example 2 on which the homogenizing treatment was not performed, and billets in example 1 and comparative example 1 on which the homogenizing treatment was performed were forged. The forging was performed according to processes A to E shown in FIG. 6. In particular, cut billets were bent and laterally put on a die, and were crushed, preformed, and formed for finishing. A forged product having a shape shown in FIG. 6 was obtained in the above-mentioned manner. According to the forging in the above direction, the segregation layer on the surface is uniformly spread out, and the formation of coarse recrystallization grains can be effectively inhibited.

f. Observation of the Surface After Forging

Figure 5A:
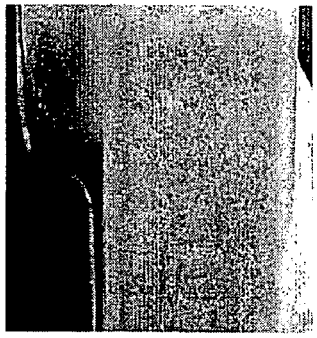
FIGS. 5A to 5C are photographs showing example forged products.
Figure 5B:
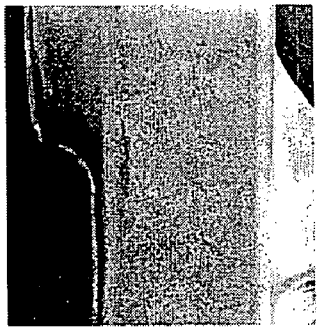
Figure 5C:
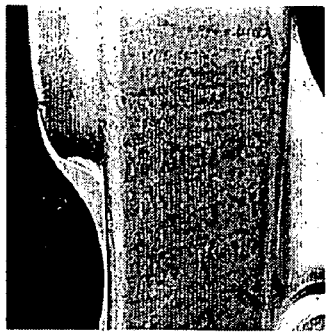

Photographs of forged products of examples 1 and 2 and comparative example 1 are respectively shown in FIGS. 5A to 5C. As is shown in these figures, the surfaces of the forged products in examples 1 and 2 were smooth. However, the surface of the forged product in comparative example 1 was rough, and the fatigue strength thereof was not satisfactory.

g. Solution Treatment and Aging Treatment

A solution treatment at 535° C. for 8 hours was performed on the forged products in examples 1 and 2 and comparative example 1, water quenching at a temperature of 60° C. was performed, and an aging treatment in which the products were heated at 170° C. for 5 hours were performed.

h. Tensile Test and Measurement of Surface Roughness

A tensile test was performed to obtain the tensile strength (MPa), the yield strength (MPa) and elongation (%) in the forged products of examples 1 and 2 and comparative example 1 on which the above-mentioned treatment "g" was performed. The surface roughness was obtained by a surface roughness measuring instrument (made by TOKYO SEIMITSU Co.; Tradename: Surfcom 550AD). Table 2 shows the measurement results for the forged products. According to the measurement results, the results of the tensile test for the forged products in examples 1 and 2 were not inferior to that of comparative example 1. Furthermore, the surfaces of the forged products of examples 1 and 2 were more smooth compared thereto. Specifically, in example 2, excellent characteristics equivalent to that of example 1 were obtained even though the homogenizing treatment was not performed. Therefore, drastic decreases in cost and weight can be achieved.

(2) Evaluation of Peeling and Glass Shot

Example 3

An upset forging was performed on the cast billet of the example 1 at a heating temperature of 480° C. without a peeling process and homogenizing treatment to obtain a forged material decreased in diameter by 20%. An homogenizing treatment was performed on the forged material at a temperature of 535° C. for 4 hours, a hardening treatment was performed at a water temperature of 60° C., and an aging treatment was performed by heating at a temperature of 170° C. for 5 hours to obtain a forged material. Hereinafter, these treatments (hardening treatment and aging treatment) will be referred to as T6 treatment.

Example 4

An homogenizing treatment was performed on the cast billet of the example 1 at a temperature of 530° C. for 8 hours, and forging and T6 treatment similar to example 3 were performed to obtain a forged material.

Example 5

A forged material of example 5 was obtained by performing shotpeening on the forged material of the example 4 using glass shot.

Comparative Example 2

A forged material of comparative example 2 was obtained in the same manner as for example 4 except for peeling, in which 1 mm of integument of the billet was cut off.

Comparative Example 3

A forged material of comparative example 3 was obtained in the same manner as for example 4 except for peeling, in which 1 mm of integument of the billet was cut off.

Comparative Example 4

A forged material of comparative example 4 was obtained by casting a billet by a gas pressurizing type of Hot-Top casting process, by performing homogenizing treatment heating at a temperature of 530° C. for 8 hours, by peeling in which 3 mm of integument of the cast billet was cut off, and by forging and T6 treatment similar to example 3.

For the above-mentioned forged materials of the examples 3 to 5 and the comparative examples 2 to 4, a tensile test was performed on test pieces having a surface layer to obtain the tensile strength (MPa), the yield strength (MPa), and the elongation (%). Plate bending test pieces were prepared, a plate bending fatigue test was performed, and the statistic of 10% failure probability was obtained. These results are shown in table 3.

TABLE 3

| | casting process | peeling | glass shot | homo-genizing treatment | fatigue strength (10% failure probability) 105 | 106 | 107 | tensile strength (MPa) | yield strength (MPa) | elongation (%) |
|---|---|---|---|---|---|---|---|---|---|---|
| example3 | heat insulating mold continuos casting | none | none | none | 183 | 109 | 84 | 346~356 | 317~328 | 11.8~15.4 |
| example4 | heat insulating mold continuos casting | none | none | done | 187 | 121 | 89 | 336~354 | 321~327 | 13.6~15.4 |
| example5 | heat insulating mold continuos casting | none | done | done | 218 | 144 | 94 | 345~351 | 320~326 | 12.2~14.0 |
| comparative example2 | heat insulating mold continuos casting | 0.1 mm (one side) | none | done | 180 | 115 | 76 | 348~355 | 319~325 | 13.4~15.2 |

TABLE 3-continued

| | casting process | peeling | glass shot | homo-genizing treatment | fatigue strength (10% failure probability) 105 | 106 | 107 | tensile strength (MPa) | yield strength (MPa) | elongation (%) |
|---|---|---|---|---|---|---|---|---|---|---|
| comparative example3 | heat insulating mold continuos casting | 1.0 mm (one side) | none | done | 167 | 104 | 69 | 347~355 | 318~330 | 13.2~15.6 |
| comparative example4 | Hot-Top casting | 3.0 mm (one side) | none | done | 170 | 97 | 65 | 282~312 | 269~293 | 7.8~12.8 |

According to the results of the tensile test, there is no large difference between the characteristics, and elongation and yield strength are maintained at high levels in spite of performing the peeling. These results suggest that the effect of inhibiting the recrystallization of the surface layer demonstrates the large effect of improving the characteristics at low-loaded stress. Moreover, in the fatigue strength, the values of the examples were approximately higher than those of the comparative examples, and recrystallization was inhibited when the peeling was not performed. Furthermore, in example 5, the fatigue strength was greatly improved, and this demonstrated that the glass shot peening was effective.

(3) Evaluation of Stress Corrosion Cracking

Example 6

A tabular forged material made of the aluminum alloy (6061) was obtained by the technique of the above-mentioned example 4, and test pieces for stress corrosion cracking tests were cut from the tabular forged material.

Example 7

An homogenizing treatment in which the aluminum alloy (6110) shown in table 1 was heated at a temperature of 520° C. for 8 hours was performed, a tabular forged material made of the aluminum alloy was obtained by forging and heat treatment similar to example 3 without peeling, and test pieces for stress corrosion cracking tests were cut from the tabular forged material.

Comparative Example 5

A tabular forged material made of the aluminum alloy (6061) was obtained by the technique of the above-mentioned example 4, a portion of the tabular forged material, which was 1 mm in thickness and included the segregation layer, was cut by a cutting process, and test pieces for stress corrosion cracking tests were cut from the tabular forged material.

Comparative Example 6

An aluminum alloy (6110) shown in table 1 was forged to obtain a tabular forged material by a technique similar to the above-mentioned example 7, except for peeling, in which 1 mm of integument of the billet cast by the technique of the above-mentioned example 1 was cut off. Then, test pieces for stress corrosion cracking tests were cut from the tabular forged material.

A boiling chromic acid corrosion test and combined corrosion test were performed by using the test pieces of examples 6 and 7 and comparative examples 5 and 6. The boiling chromic acid corrosion test was performed in the following manner. $CrO_3$: 36 g/l-$K_2Cr_2O_7$: 30 g/l-NaCl: 3 g/l was used as a promotion liquid to shorten the time for the stress corrosion cracking test. A test piece in which test stress was set at 85% of the actual yield strength was dipped into the boiling promotion liquid. The test piece was taken out after 5 hours to observe the existence of cracks. The combined corrosion test was performed in the following manner. A test piece in which test stress was set at 85% of the actual yield strength was charged in a test furnace in which salt water dipping, spraying, drying, wetting, and drying were alternately repeated. The test piece was taken out after 7200 hours to observe the existence of cracks. The results are shown in table 4.

TABLE 4

| | alloy | casting process | peeling | sorface working for test piece | boiling chromic acid corrosion stress corrosion cracking | boiling chromic acid corrosion pitting corrosion depth | compound corrosion stress corrosion cracking | compound corrosion pitting corrosion depth |
|---|---|---|---|---|---|---|---|---|
| example 6 | 6061 | heat insulating mold continuos casting | none | as cast (mill scale) | none | 50.8 μm | none | 26 μm |
| comparative example 5 | 6061 | heat insulating mold continuos casting | none | done | none | impossible to measure | none | 30 μm |

TABLE 4-continued

| | alloy | casting process | peeling | sorface working for test piece | boiling chromic acid corrosion stress corrosion cracking | boiling chromic acid corrosion pitting corrosion depth | compound corrosion stress corrosion cracking | compound corrosion pitting corrosion depth |
|---|---|---|---|---|---|---|---|---|
| example 7 | 6110 | heat insulating mold continuos casting | none | as cast (mill scale) | none | 63.6 μm | none | 23 μm |
| comparative example 6 | 6110 | heat insulating mold continuos casting | done | as cast (mill scale) | none | 68.8 μm | none | 43 μm |

(4) Evaluation of Temperature in Homogenizing Treatment

An homogenizing treatment for a billet made of the aluminum alloy (6061) cast by the technique of example 1 was performed by heating at 500° C., 520° C., 540° C., 560° C., or 580° C. for 8 hours respectively, as shown in table 5. Moreover, a homogenizing treatment for a billet made of the aluminum alloy (6110) cast by the technique of example 1 was performed by heating at 500° C., 520° C., 540° C., 560° C., or 580° C. for 8 hours respectively, as shown in table 5. For these billets, the existence of the generation of eutectic melting in the surface layer was examined. In addition, the existence of blistering after the forging was examined. The results are shown in table 5.

TABLE 5

| Al alloy | | homogenizing treatment temperature (° C.) 500 | 520 | 540 | 560 | 580 |
|---|---|---|---|---|---|---|
| 6061 | eutectic melting | none | none | exists | exists | exists |
| | blistering after forging | none | none | none | exists | exists |
| 6110 | eutectic melting | none | none | exists | exists | exists |
| | blistering after forging | none | none | exists | exists | exists |

According to table 5, in the 6061 aluminum alloy, when the temperature of the homogenizing treatment was more than 540° C., traces of eutectic melting in the surface layer were observed. When the material with this trace was forged, a blister was generated after the solution treatment. Conventionally, the temperature of the homogenizing treatment was 540 to 560° C. However, this temperature range was not preferable. Moreover, when the temperature was less than 520° C., the uniformity of the structure was insufficient. Therefore, the preferable temperature range of the homogenizing treatment is not less than 520° C. and less than 540° C. That is to say, the preferable temperature range of the homogenizing treatment is a temperature range of 20 to 40° C. below the solidus temperature in the segregation layer (for example, 559° C. in the case of the 6061 aluminum alloy). Then, the preferable temperature of homogenizing treatment is assumed to be 510 to 530° C. in the 6110 aluminum alloy, in which the solidus temperature of the segregation layer is 552° C. In this temperature range, eutectic melting and blistering after the forging did not actually occur. Accordingly, it was demonstrated that the preferable temperature of the homogenizing treatment was 20 to 40° C. below the solidus temperature in the segregation layer.

(5) Effects of Additive Elements

The 6061 aluminum alloy to which Be and Ca were added with the amounts of shown in table 6 were added was forged by the technique of example 1 to observe the cast surface. The results are also shown in table 6. According to table 6, a smooth cast surface was obtained by the addition of 0.0005 to 0.0020 wt % of Be, and by addition of 0.005 to 0.015 wt % of Ca.

TABLE 6

| | | | | | | | |
|---|---|---|---|---|---|---|---|
| content (wt %) | ○ | 0.0005 | 0.001 | 0.002 | 0.004 | | |
| Be | X | ○ | ○ | ○ | X | | |
| content (wt %) | 0.001 | 0.005 | 0.0075 | 0.01 | 0.0125 | 0.015 | 0.02 |
| Ca | X | ○ | ○ | ○ | ○ | ○ | X |

Figure 7A:
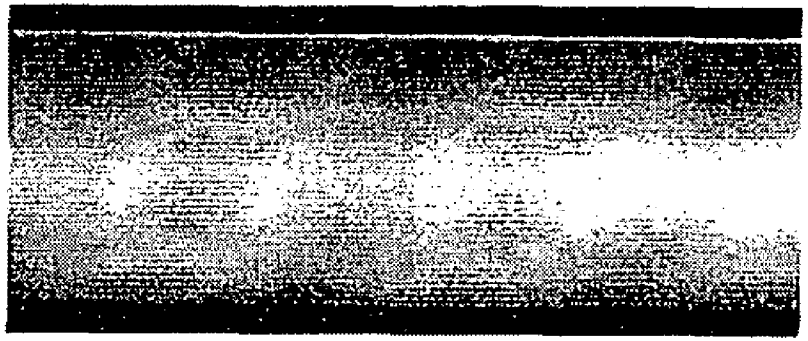
FIG. 7A shows a photograph of an example cast billet in which the casting rate was not varied.
Figure 7B:
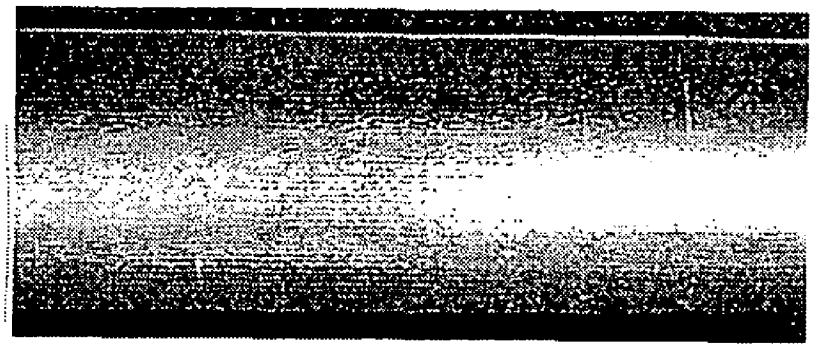
FIG. 7B is a photograph of an example cast billet in which casting rate was fixed.

○: casting surface is smooth
X: casting surface is rough (6) Evaluation of Casting Rate In the casting process of the above-mentioned example 1, casting was performed by increasing and delicately varying casting rate around 150 mm/min. Another casting was performed by fixing the casting rate at 170 mm/min. FIG. 7A shows a casting bar in which the casting rate was varied. FIG. 7B shows a casting bar in which the casting rate was fixed. According to FIGS. 7A and 7B, the cast surface was smooth when the casting rate was varied, and the cast surface was rough when the casting rate was fixed. Moreover, FIG. 7A is a cross section showing the micro structure of the casting bar after homogenizing treatment. According to FIG. 7B, eutectic melting was not observed, and a preferable structure in which the eutectic portion is made spherical was obtained.

What is claimed is:

1. An aluminum alloy billet as cast for forging, obtained by a continuous casting process, the alloy comprising: 0.005 to 0.015 wt % of Ca, a surface of which roughness is not more than Ra 17, and a segregation layer having 0.2 to 2 mm thickness and generated in the surface.

2. An aluminum alloy billet as cast for forging, obtained by a continuous casting process, the alloy comprising: 0.0005 to 0.020 wt % of Be, a surface of which roughness is not more than Ra 17, and a segregation layer having 0.2 to 2 mm thickness and generated in the surface.

3. A continuous casting process for an aluminum alloy billet as cast in accordance with claim 1 for forging, the process comprising: charging a melted metal consisting of the aluminum alloy material into a mold at a predetermined casting rate, the mold having a discharge edge through which the solidified aluminum alloy material is discharged; and controlling the casting rate such that a solidification interface of the aluminum alloy material is positioned inside the mold away from the discharge edge.

4. A continuous casting process for an aluminum alloy billet as cast in accordance with claim 2 for forging, the process comprising: charging a melted metal consisting of the aluminum alloy material into a mold at a predetermined casting rate, the mold having a discharge edge through which the solidified aluminum alloy material is discharged; and controlling the casting rate such that a solidification interface of the aluminum alloy material is positioned inside the mold away from the discharge edge.

* * * * *